United States Patent [19]

Dion

[11] 4,380,201

[45] Apr. 19, 1983

[54] BANK CONSTRUCTION

[76] Inventor: Exsior Dion, 547 River Rd., Lincoln, R.I. 02865

[21] Appl. No.: 242,288

[22] Filed: Mar. 10, 1981

[51] Int. Cl.[3] ..... E06B 9/04; E05G 5/02; G08B 13/00

[52] U.S. Cl. ..... 109/17; 109/5; 109/21; 109/21.5

[58] Field of Search ..... 109/2, 3, 4, 5, 6, 9, 109/10, 21, 21.5, 11, 12–13, 15, 17, 43; 116/202; 40/459

[56] References Cited

U.S. PATENT DOCUMENTS

| | | | |
|---|---|---|---|
| 250,663 | 9/1912 | Wenzel | 109/17 |
| 1,564,127 | 12/1925 | Craig | 109/17 |
| 1,921,557 | 8/1933 | Bowman | 109/13 |
| 2,984,194 | 5/1961 | Jennings | 109/17 |
| 3,537,409 | 11/1970 | Farley | 109/19 |

*Primary Examiner*—Robert Peshock
*Assistant Examiner*—John G. Weiss
*Attorney, Agent, or Firm*—Robert J. Doherty

[57] ABSTRACT

A construction such as a building or the like in which banking transactions can be conducted in a more secure and businesslike manner. In essence, the structure is divided into a banking area and a teller's area by a security wall against which a plurality of individual booths are constructed in the banking area. Various communication and security means are provided in the booth such that the booth is locked from the teller's area such that robberies are initially discouraged and, if attempted, successfully foiled by the locking of the attempted robber in the booth to await security forces such as the police. In addition, the booths are each provided with a transaction opening in the security wall such that money, checks, etc. may pass between the teller's area and the booth. This transaction opening is adapted to be closed by a slidable door in the event that the opening is utilized to stage an attempted robbery. The door is additionally provided with a substantially V-shaped edge so as to engage any elongated object such as a gun barrel on opposite sides and force it into a predetermined position where any bullet emanating therefrom may be caught by a shot absorber.

6 Claims, 8 Drawing Figures

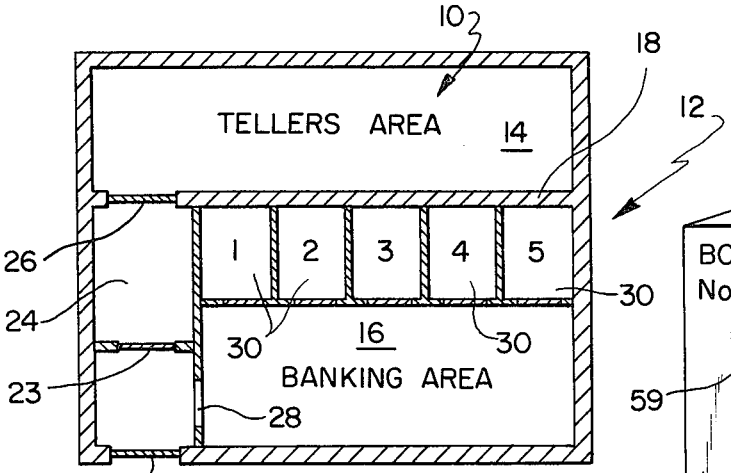
FIG. 1
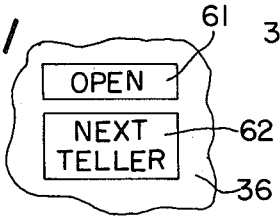
FIG. 2A
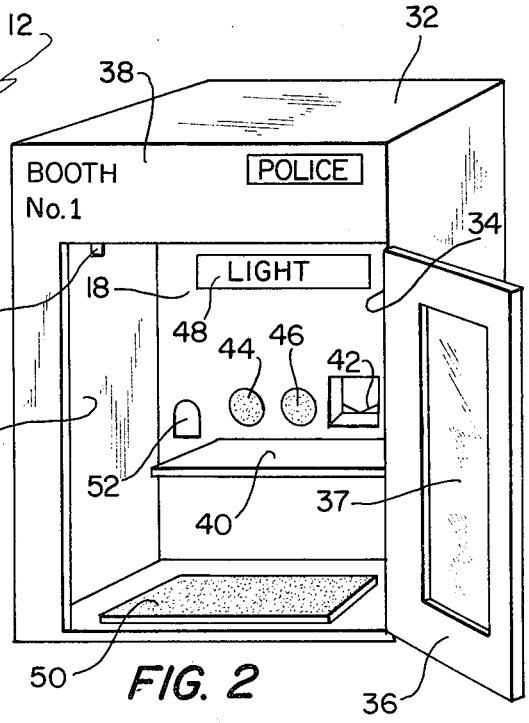
FIG. 2
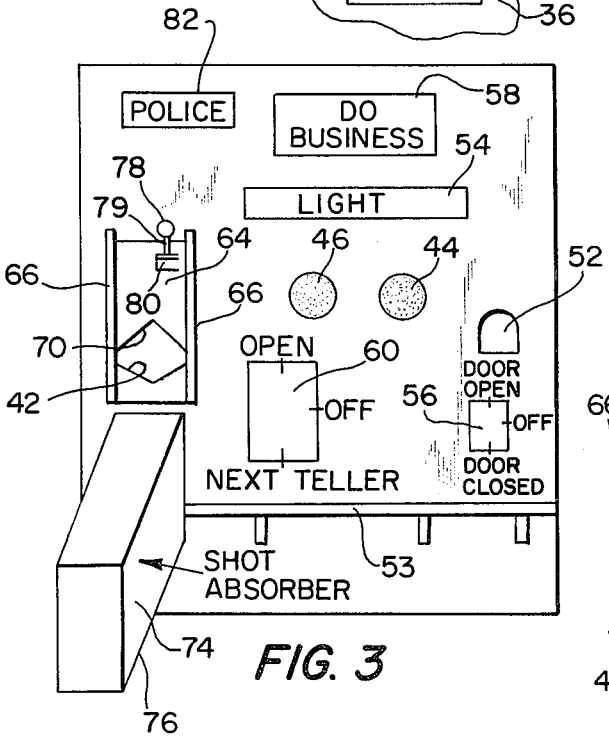
FIG. 3
FIG. 4
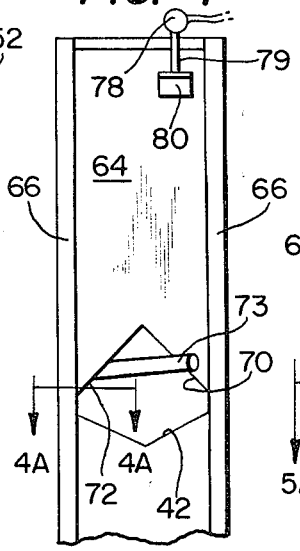
FIG. 5
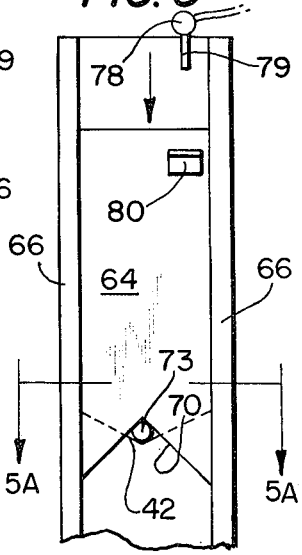
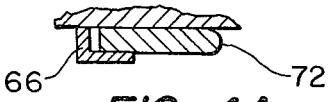
FIG. 4A
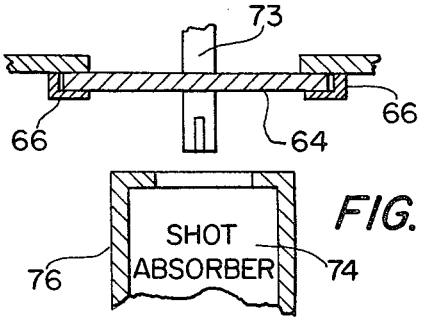
FIG. 5A

BANK CONSTRUCTION

BACKGROUND AND SUMMARY OF THE INVENTION

This invention relates to a constructional assembly in which banking transactions and the like may be conducted in a businesslike and secure manner. More particularly, the invention is directed to a building construction such as a bank wherein banking customers are separated from each other and the tellers while they are conducting banking transactions such that the utmost security is afforded not only to the the banking customers but also to the tellers and bank management personnel as well.

Numerous schemes and devices have been employed to increase bank security including armed guards, television monitors, and the like. However, bank robberies continue and subject both bank employees and customers of the bank present while a robbery is in progress to substantial danger. Accordingly, it would be desirable to both reduce the frequency of attempted bank robberies and also reduce their severity from the point of potential injury to tellers and other customers on those occasions when they are attempted.

A further drawback to normal banking transactions is that a relative lack of privacy is afforded to the banking customer while transacting his or her business. Thus, other customers can often readily observe what is taking place. Also, there are numerable occasions in which there is no need for the teller to become associated with the physical identity of the customer as in deposits and the like, and this face to face meeting can be an irritant or a drawback to banking business for those who do not wish tellers and other bank employees, who might impart such information to others, to know their personal business. It would, accordingly, also be a desirable feature to accommodate a degree of privacy herethereto unachievable in conventional banking transactions.

These and other objectives of the present invention are accomplished by a building having a first area accessible to all customers and a teller's work area, said areas separated from each other by a security wall, a plurality of separate generally fully enclosed customer booths positioned along said security wall, each of said booths having access thereto by a door opening into said first area, said door openable, closable, and lockable from said teller's work area, signal means responsive to the closing and locking of said door to signal a teller as to readiness to transact business, communication means between said teller and said customer, the security wall portion of said booth having a passage therethrough, said passage mutually opening into said booth and said tellers area whereby business between the teller and the customer may be transacted, and means operable from the teller's area to close said opening.

Other objects, features and advantages of the invention shall become apparent as the description thereof proceeds when considered in connection with the accompanying illustrative drawing.

DESCRIPTION OF THE DRAWING

FIG. 1 is a plan view of a bank format constructed in accordance with the principles of the present invention;

FIG. 2 is a perspective view on an enlarged scale of the interior portion of one of the banking booths shown in FIG. 1;

FIG. 2A is a partial view of the front of one of the booth doors;

FIG. 3 is a perspective view on an enlarged scale of that portion of the teller's area opposite one of the booths as shown in FIG. 2;

FIG. 4 is an enlarged plan view of the sliding door through which the transaction opening may be closed in the case of an emergency;

FIG. 4A is an enlarged sectional view taken along the line 4A—A of FIG. 4;

FIG. 5 is a view similar to FIG. 4 but showing the door in a closed activated position; and FIG. 5A is a cross-sectional view taken along the line 5A—5A of FIG. 5.

DESCRIPTION OF THE INVENTION

Turning now to the drawing and particularly FIG. 1, the overall format of the floor 10 of a building 12 such as a bank or the like is shown. The floor is divided into a teller's area 14 and a general customer's or banking area 16 by means of a security wall 18. The security wall 18 may be formed from concrete blocks or other suitable building materials such that a high degree of security is provided between these areas. In addition, the building is provided with an entrance door 22 whereby access to the bank by both employees and customers is had. Also, the teller's area 14 is separately accessible only through an employee door 23 into corridor 24, then through door 26. Door 22 is positioned at one face of a corner leading to a corridor entrance and to the banking area. Another entrance door (not shown) may be provided to the banking area, e.g., at the other corner of the building. Door 22 is always unlocked for employees and customers to enter or leave. Door 28 is always unlocked for customers to enter or leave the banking area during banking hours. Before banking hours, all employees enter door 22 then enter door 23 into the corridor 24 through door 26 into the teller's area 14. Door 23 and door 26 are then locked before customers enter the banking area through door 22 and 28 which remain unlocked during banking hours. For instance, the employee door 23 could be accessible only through a lock to gain entrance to a corridor 24 which leads to a further security door 26 in the security wall 18 such that a teller or other employee would have to be physically identified by those in the teller's area 14 before access to the area would be gained.

The banking area 16 is further provided with a plurality of transaction booths 30 numbered in sequence 1 through 5 in FIG. 1 and each constructed so as to be substantially enclosed and positioned adjacent the security wall 18 such that such wall forms a part of the enclosure of each of the booths 30. Turning now to FIG. 2 of the drawing in particular, the operational format of the booths 30 is best shown. Therein, the booth 30 includes top 32 and side walls 34 and a door 36 through which entrance to the interior portion of the booth may be secured. The door may also be constructed of transparent or translucent material or if not includes a window 37 made from suitable non-breakable material such as plastic sheet or tempered glass. The top of the booth 30 is provided with a facade 38 on which indicia indicating the booth number as well as instructional signs as will hereinafter be more fully described may be situated.

The interior of the booth is provided with a shelf 40 on which a customer may place objects in preparation for banking transactions and a V-shaped window or opening 42 formed through the security wall 18 and through which money, checks, papers, and the like may be passed to the teller situated in the teller's area 14 and vice-versa. In addition, communication means in the form of a speaker 44 and a receiver 46 are present in the booth such that the customer standing therein may have voice communication with the teller servicing him or her behind the security wall 18. Such communication means may be in constant operation or operated by activation switches (not shown). In addition, a light 48 is provided in a suitable position such that the customer can see what he or she is doing. The light 48 is preferably activated by a weight responsive floor mat 50 such that when a customer steps into the interior of the booth and on the mat 50, the light 48 is activated. A peep hole 52 is provided through the security wall 18 and preferably on the left-hand or closing side of the door 36 such that the teller may observe whether or not a person or object is positioned so as to prevent the full locking closure of the door 36 which as hereinafter will be indicated is controlled by the teller.

The side of the security wall 18 opposite the booth shown in FIG. 2 (that is, in the teller's area 14) is also provided with a number of controls and devices as best shown in FIG. 3 of the drawing and including a work shelf 53. Therein a light or other signal device 54 is mounted on the wall and is activatable by the customer stepping on the mat 50 so as to indicate that a potential customer is in the booth. At such time, the teller ascertains whether or not anything is blocking closure of the door by looking through the peep hole 52 and thereafter activates the door by means of a switch 56 so as to close and preferably also lock the door 36. The switch 56 opens and closes the booth door 36 by an electrical mechanism on the door (not shown). When not in use, the switch 56 is turned to the OFF position. When the door is properly closed, a signal such as a secondary and different colored light 58 is activated by a momentary electric switch 59 mounted on the facade 38 and operated by contact with the door 36 so as to show the teller that the door of the booth is now closed and that the business transaction may begin.

At this time, business is transacted through a window opening 42 at which time the teller and customer may be in oral communication via the speaker 44 and the receiver 46. A switch 60 is provided by which the teller can activate as by lighting various indicia on the outside of the booth door; for instance, an "Open" sign 61 which indicates that the teller is ready to do business and a "Next Teller" sign 62 which indicates that a customer should go to the next available booth. The switch 60 is turned to "Off" at the end of the working day. This indicia and other appropriate messages may be activated by the teller or may be incorporated as part of the closure switch 56. Also the indicia, signals, etc. may take several physical forms; that is, the signals may be as straightforward as conventional light bulbs or may be covers bearing a message which is then readable by being backlit. Other appropriate formats may also be used.

As best shown in FIGS. 4 and 5, the transaction opening 42 may be closed by means of a slidable door or panel, i.e., a closure member 64 mounted on the teller's side of the wall 18 and preferably formed of steel or some other high strength material and of a generally planar configurations. The door 64 is mounted in slots or grooves 66 laterally spaced from each other on opposite sides of the opening 42. This sliding door 64 is closed by electrical means using a switch (not shown) placed away from the opening 42 to protect the teller from injury. The bottom edge of the door 64 is preferably provided with an inverted V-shaped notch 70, the edges 72 of which are rounded. In this manner, if any elongated object 73 is forced through the transaction opening 42 as by a customer; i.e., a gun barrel, the downward movement of the slidable door 64 will, as shown in the transition between FIGS. 4 and 5, engage the object on opposite sides thereof by contact with the notch 70. Also, the base of the opening 42 is preferably V-shaped so as to coact with the inverted V-shaped notch in the door 64 so as to thus improve the centering action upon the object as hereinafter described.

Such action will force the object away from the teller and towards a predetermined area in which a shot absorber or other similar device 74 is located. Such shot absorber 74 may assume may convenient shape but generally includes an outer housing 76 and is filled inside with material such as medium hard rubber, plastic, sand, etc. for the purpose of holding or absorbing the impact of a bullet that may be fired from such object 74. The forward wall (not shown) of the shot absorber 74 is provided with an opening which corresponds to the aforementioned predetermined area such that the trajectory of the barrel 73 will be in line with such shot absorber opening. Also, inasmuch as the edges 72 of the lower end of the door 64 are rounded as shown in FIG. 4A, any tendency for a gun barrell or other elongated object 73 to stick or become hung up on the edges will be reduced.

An open circuit switch 78 is placed securely on the wall 18 just above the top of the sliding door 64. This switch includes a switch button or rod 79 downwardly extending therefrom. An angled element or switch activator 80 is securely attached to the upper part of the sliding door in line with the switch button 79. When the door is in its normal up position, the switch activator 80 contacts the switch button to hold such in the off position against the action of a switch button spring thus making an open circuit when the door is activated to slide downwardly, the switch button inner spring pushes the button down to complete the circuit so as to turn on an alarm 82 in the teller's area 14 such as a flashing red light. In addition, activation of the door 64 preferably also automatically activates a signal in the local police station so as to alert them of a possible holdup attempt. Also, a signal; i.e., a flashing "Police" sign, may be activated on the facade of the booth such that customers in the general area 16 may be alerted to the possible danger and flee. Accordingly, if a customer attempts a holdup or other criminal activity while in the booth, he or she is locked therein and the teller or other bank employee simply waits until the police or other security forces arrive to subdue the would be bank robber. In this regard, the window 37 in the closure door 36 enables the condition of the apparent criminal to be observed by the proper security forces. The window is however not of an extent such normal business transactions conducted while in the booth can be observed by other customers.

In this way then not only is the bank teller servicing the would be criminal protected from harm, as through the presence of the security wall and the sliding door in combination with the shot absorber, but furthermore other customers of the bank are protected inasmuch as the would be criminal is locked within the booth. As an additional precaution, the police or other security people responding to the emergency signal should be identified and cleared into the banking area by means of positive identification or some prearranged signal such that a would be robber will not utilize outside accomplices dressed as policemen or other security forces to accomplish a release from the locked booth.

In summary, operation of the improved bank construction may be had by the following descriptive operation of the booths. The teller starts the working day by flipping up an electric switch toward "open" on the left side of the wall, lighting a green neon sign marked "Open" on the transparent booth door thereby notifying the customers to enter the booth. The booth door does not open or close by this switch. All transparent doors of the booths in the bank remain in the open position day and night only when a customer enters the booths, steps onto the electric floor mat lighting the inside of the booth also lighting a light on the teller's wall with the teller looking through the peep opening to notice if there is a child or object in the doorway before pressing the switch on the right side of the wall to close the door electrically operated. The door fully closed presses firmly on a momentary electric switch causing a green bulb to light on the teller's wall. DO BUSINESS. After the business is completed through the window or opening the teller uses the same switch on the right side of the wall to open the door and release the customer. If the teller is busy with other matters, he or she may activate the switch to "Next Teller" notifying the customers not to enter that booth to do business. Communication between the teller and customer is done through a speaker and receiver. At the end of the working day switches that are marked "Off" should be turned to "OFF". If an attempted robbery is made by a note or gun barrel put through the window, the teller will then press a remote switch to electrically close the V at the base of the sliding steel door onto the V-shaped base of the window so as to push the gun barrel from either side and center it in line with the shot absorber which is packed with material to absorb the shots. Also, the alarm 82 may be activated by providing the steel sliding door with a welded angle member (not shown but similar to switch activator 80 near the top thereof to hold an open circuit switch button in keeping the circuit open until such time the door is lowered. As soon as the steel door is lowered, the switch button is lowered by an inner spring completing a circuit having a flasher lighting a red light in the teller area, a red light in the banking area, and a green light at the police station notifying all that there is an attempted holdup going on in the bank.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A constructional assembly for conducting improved banking transactions comprising a structure having a first area generally accessible to customers and a teller's work area, said areas separated from each other by a security wall, a plurality of separate, generally fully enclosed customer booths positioned along said security wall, each of said booths having access thereto by a door opening into said first area, said door closable and lockable from said teller's work area, signal means responsive to the closing of said door to signal a teller as to readiness to transact business, communication means between said teller and said customer, a portion of the security wall of said booth having a transaction passage therethrough, said passage mutually opening into said booth and said teller's area whereby business between the teller and the customer may be transacted, and means operable from the teller's area to close said passage, including teller operational control means for signalling a normal operational sequence including that the booth is available, that a customer is in the booth, that the booth door is closable, that the booth door is closed and locked and for opening said door and initiating another sequence.

2. The assembly of claim 1 including a slidable member for closing said transaction passage opening in an emergency, said member mounted above said opening and vertically movable to close the same, open circuit means at the upper end of said member such that closing movement thereof closes said circuit and signals an emergency in at least the teller's area.

3. A constructional assembly for conducting improved banking transactions comprising a structure having a first area accessible to a customer and a teller's work area, said areas separated from each other by a security wall, a portion of said security wall having a transaction passage therethrough, said passages mutually opening into said areas whereby business between the teller and the customer may be transacted, means operable from said teller's area to close said passage, said means for closing said passage being a closure member mounted with one edge thereof proximal said passage and slidable across said teller's area opening thereof, and said slidable member one edge provided with means such that an elongated object such as a gun barrel forced into said passage opening will be contacted by such means so as to direct the trajectory of such object to a predetermined area within said teller's area by the sliding movement of said member.

4. The assembly of claim 3, said slidable member being a closure panel slidable across said passage opening so as to substantially close the same and having a substantially inverted V-shaped notch disposed in said one edge thereof and said one edge being substantially rounded.

5. The assembly of claim 4, wherein the base of said passage is provided with a V-shaped notch and said slidable panel is provided with an inverted V-shaped notch, said notches aligned with each other such that the edges of said door and said passage respectively defining said notches will contact an elongated object such as a gun barrel forced into said passage opening so as to cooperatively direct the trajectory of said object to a predetermined area within said teller's area upon the closing movement of said panel.

6. The assembly of claim 4, including a shot absorber disposed at said predetermined area.

* * * * *